US006383088B1

(12) United States Patent
Kershner

(10) Patent No.: US 6,383,088 B1
(45) Date of Patent: May 7, 2002

(54) GOLF CLUB RETENTION DEVICE

(76) Inventor: Gary Patrick Kershner, 1768 E. Pleasant Valley Rd., Cleveland, OH (US) 44131

( * ) Notice: Subject to any disclaimer, the term of this patent is extended or adjusted under 35 U.S.C. 154(b) by 0 days.

(21) Appl. No.: 09/513,410

(22) Filed: Feb. 25, 2000

Related U.S. Application Data

(60) Provisional application No. 60/122,944, filed on Mar. 5, 1999.

(51) Int. Cl.[7] ..... A63B 55/10

(52) U.S. Cl. ..... 473/282; 248/156; 211/70.2

(58) Field of Search ..... 473/282; 211/70.2, 211/70.8; 43/21.2; 248/530, 512, 539, 156, 751; D21/796

(56) References Cited

U.S. PATENT DOCUMENTS

| | | | | |
|---|---|---|---|---|
| 4,371,022 | A | | 2/1983 | Goulart |
| 4,805,911 | A | | 2/1989 | Ferlazzo et al. |
| 5,127,530 | A | | 7/1992 | Ortuno |
| 5,226,666 | A | | 7/1993 | Dinkens, Jr. |
| 5,285,990 | A | | 2/1994 | Engel |
| 5,332,090 | A | * | 7/1994 | Tucker |
| 5,417,334 | A | | 5/1995 | Wu |
| 5,474,191 | A | | 12/1995 | Bergeron et al. |
| 5,597,363 | A | * | 1/1997 | Leote |
| 5,636,734 | A | | 6/1997 | Smith |
| 5,820,479 | A | | 10/1998 | Cline et al. |
| 5,829,604 | A | | 11/1998 | Brophy |

* cited by examiner

*Primary Examiner*—Stephen Blau
(74) *Attorney, Agent, or Firm*—Fay, Sharpe, Fagan, Minnich & McKee, LLP

(57) ABSTRACT

The present invention, a golf club caddy apparatus allows for the convenient transportation and support, of golf clubs and golf accessories around a golf course putting green or practice tee. The apparatus releasably retains one or more golf clubs in a secure and convenient manner to facilitate play around a putting green or practice tee. The golf club caddy apparatus further facilitates play by being securely, yet releasably connected to the exterior of a golf bag when not in use. The golf club caddy apparatus allows a player to conveniently transport other associated golf accessories such as a personal towel, a pencil and golf tees.

15 Claims, 4 Drawing Sheets

GOLF CLUB RETENTION DEVICE

CROSS-REFERENCE TO RELATED APPLICATION

This application claims the benefit of U.S. Provisional Application No. 60/122,944, filed Mar. 5, 1999, and this prior application is expressly hereby incorporated by reference herein.

BACKGROUND OF THE INVENTION

The present invention relates to golf accessories. More particularly, it relates to a device for releasably retaining one or more golf clubs so that the clubs are readily available as needed around a golf course putting green and so that the clubs can be carried using the device and supported in an upright manner around a putting green (or a practice tee) as needed. The device is adapted for selective attachment to a golf bag when it is not in use.

In golf, once a player's ball is in the vicinity of the putting green, it is common for the player to leave his or her bag and carry only the clubs thought necessary for hitting the ball onto the green and into the hole. This eliminates the need for the player to carry his or her entire bag around the green. Also, many players utilize golf carts which are not permitted to travel on or near the putting greens. Thus, rather than return to the cart after each shot near the green to retrieve a new club, players typically carry all of the clubs they believe may be required to complete the hole.

Obviously, it is inconvenient for players to carry multiple clubs as described. Frequently, players lose track of the clubs and leave one or more of them on or near the green after the hole is completed. Also, when making a shot, the player must lay all other clubs on the ground where the grips can become wet or dirty. Of course, a player must then bend over to retrieve the clubs—an activity which many golfers wish to avoid. Another problem associated with manually carrying clubs around a putting green is that a player is discouraged from carrying all of the needed clubs. Thus, for example, a player may carry only a sand wedge and a putter, even though the player may require a pitching wedge, a chipper, or the like. The player simply does not desire to carry all of these clubs and will rely on those he/she has selected in advance (often before even viewing the "lie" of the ball), even though it is possible that none of the selected clubs will be proper for the next shot.

Also, when hitting golf balls from a practice teeing area, golfers do not want to (or are not allowed to) carry their entire bag to the teeing area. Heretofore, golfers have had to carry their entire bag to the practice tee or have had to carry multiple clubs without aid of a suitable carrying device. Also, once at the practice tee, there has been found a need for a device for supporting clubs in an upright, secure, and convenient manner to allow a golfer to focus on his/her practice swings and to warm-up more efficiently and effectively.

Accordingly, there has been found a need for a device which allows a player to conveniently carry multiple clubs around a putting green or practice tee as needed, and to support these clubs in a convenient manner so that the player has access to needed clubs and is less likely to forget the clubs on the green after finishing the hole. Also, there has been found a need for such a device which conveniently attaches to a golf bag as required, and which may also be used to support the green flag and other golfing items such as tees, green repair tools, and balls.

SUMMARY OF THE INVENTION

The present invention relates to a device for releasably retaining golf clubs in a secure and convenient manner to facilitate play around putting greens and at a practice tee.

One advantage of the present invention is that it releasably retains and supports multiple golf clubs in a convenient manner for use on and around a putting green or practice tee.

Another advantage of the invention is that it supports multiple clubs in an upright manner with the heads near the ground to minimize accidental tipping of the device.

Still another advantage of the present invention is that golf clubs secured thereby are partially released upon insertion of the device into the ground to facilitate separation of a club from the device.

Another advantage of the present invention is found in its ability to securely yet releasably connect to the exterior of a golf bag while not being used around a putting green.

Still another advantage of the invention is that it eliminates the need to carry multiple separate clubs and lay these clubs on the ground when they are not in use.

Yet another advantage of the invention is that it reduces the likelihood a player leaving a club on or near a green after completing a hole.

A further advantage of the invention is that it is adapted to support the flag of a green in a manner which protects the flag and green from damage and in a manner which keeps the flag, itself, from contacting the green.

A still further advantage of the invention is that it speeds play by encouraging golfers to carry multiple clubs around the green, thus, eliminating the need for golfers to return to their bag after a ball is successfully landed on the green.

Another advantage of the invention is that it lowers golf scores by ensuring that players have the proper club selection to effect a golf shot around a green.

Still another advantage of the invention is that it is adapted to carry a ball, tees, a green repair tool, and the like.

Another advantage of the present invention resides in its ability to aerate the ground into which it is inserted on and around putting greens without causing damage.

Still other benefits and advantages of the invention will become apparent to those of ordinary skill in the art upon reading and understanding the present application.

BRIEF DESCRIPTION OF THE DRAWINGS

The invention may take form in certain components and structures, preferred embodiments of which are illustrated in the accompanying drawings which form a part hereof and wherein.

DETAILED DESCRIPTION OF THE INVENTION

Figure 5:
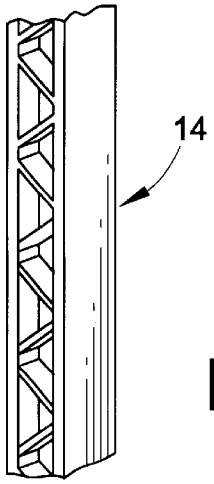
FIG. 5 is a partial perspective view of a shank portion of the golf club retention device of FIGS. 1–4 formed in accordance with a preferred embodiment of the present invention.

Referring now to the drawings wherein preferred embodiments of the subject golf club retention device are illustrated, the device 10 comprises an elongated shank 14 having opposite first and second axial ends 16,18. A spike 12, preferably fabricated of heat-treated steel, projects coaxially outwardly from the second, lower end 18 of the shank 14. Other than the spike 12, the device 10 is preferably conformed as a one-piece construction from injection molded polypropylene or other conventional plastic material. Of course, other materials and forming techniques may be utilized to construct the device 10 without departing from the overall scope and intent of the invention. A preferred construction of the shank 14 is illustrated in FIG. 5. The shank 14 comprises an open, web-like structure that minimizes weight, increases strength, and facilitates the injection molding process.

Figure 1:
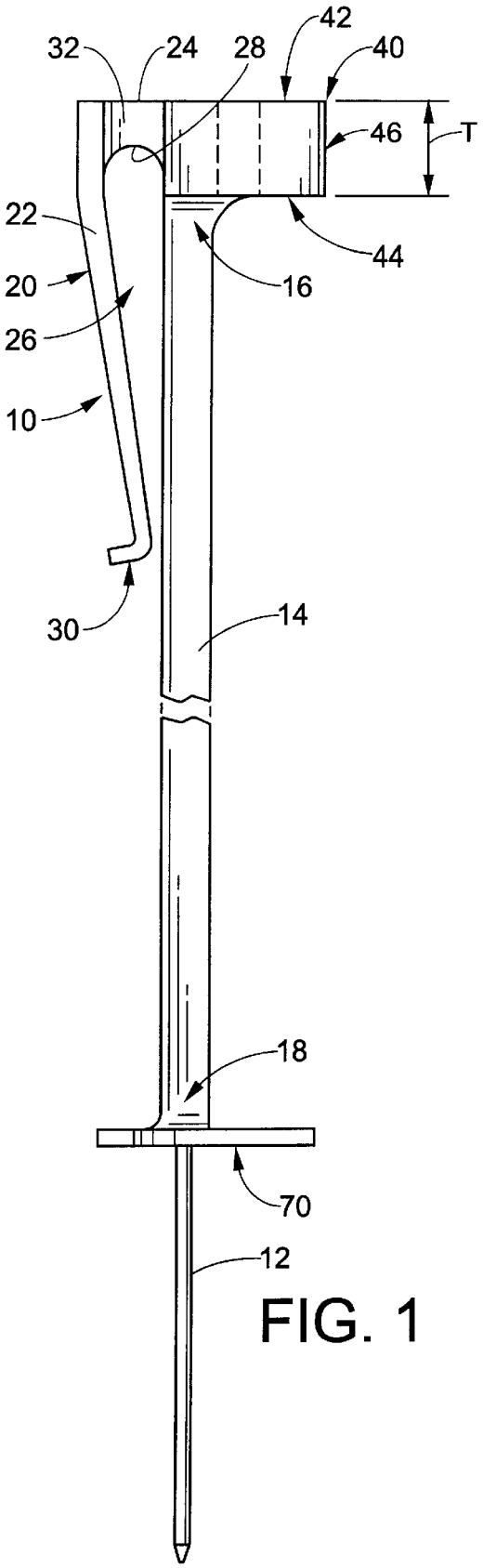
FIG. 1 is a side elevational view of a golf club retention device formed in accordance with the present invention.
Figure 2:
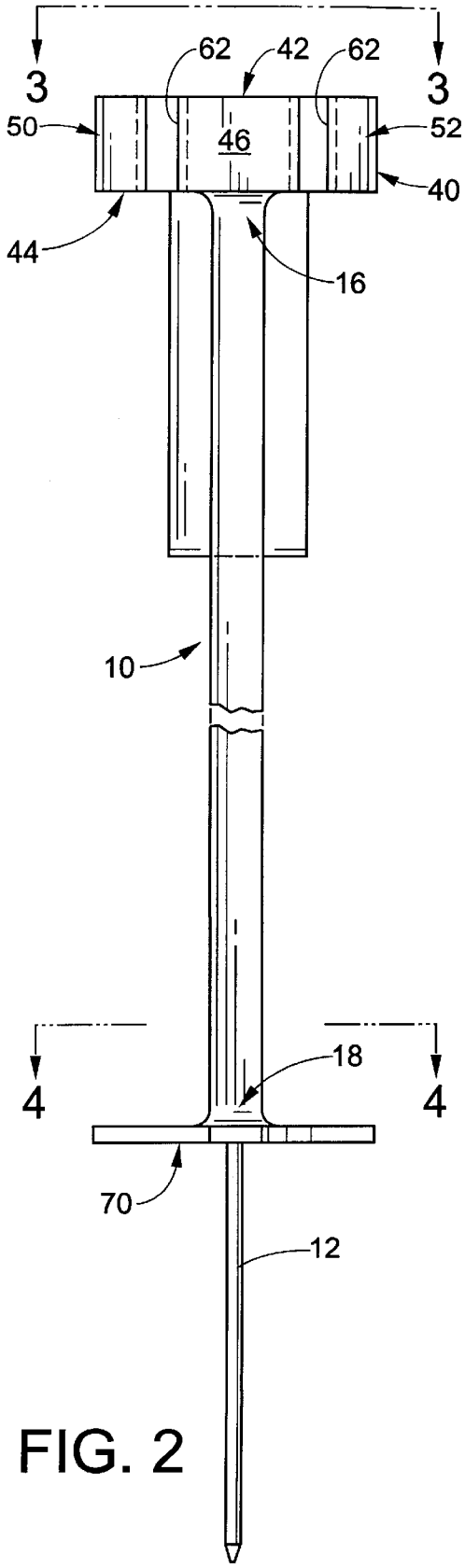
FIG. 2 is a front elevational view of the golf club retention device illustrated in FIG. 1.
Figure 3:
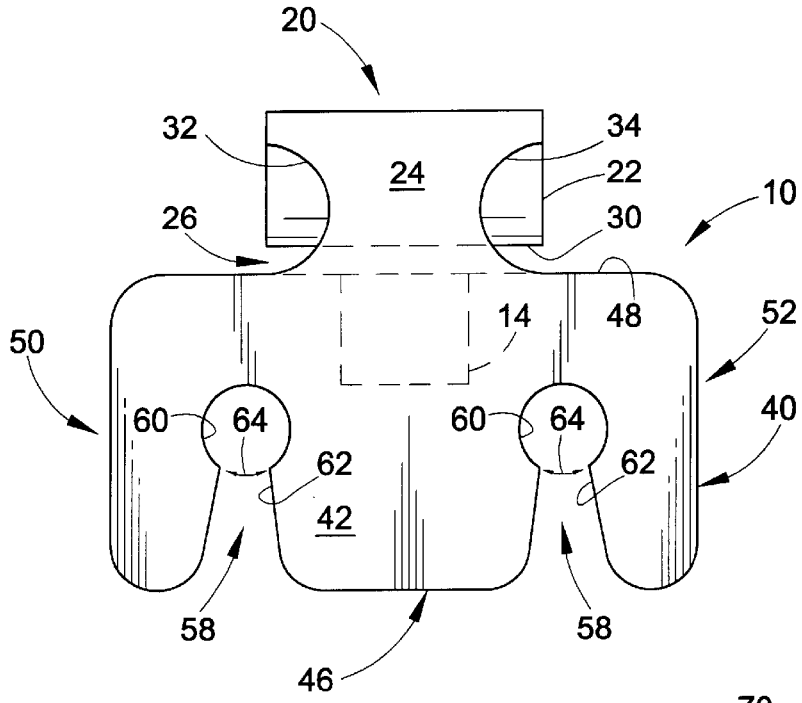
FIG. 3 is a top plan view of the golf club retention device taken along line 3—3 of FIG. 2.

The device 10 comprises a clip portion 20 connected to the upper end 16 of the shank 14. The clip portion 20 includes a finger 22 connected to the shank 14 by way of a horizontally extending connector arm 24. The finger 22 depends from the connector arm 24 and a lower distal end converges toward the shank 14 so that a slot 26 is defined between the finger 22 and the shank 14. The innermost end of the slot 26 is defined by a curved portion 28 of the connector arm which is shaped to conform to the upper edge of a golf bag B (FIG. 6A). Due to the natural resilience of the plastic material from which the device 10 is formed, the finger 22 is resiliently biased toward the shank 14 and is selectively movable away therefrom to receive a golf bag upper edge in the slot 26. The lowermost, distal end of the finger 22 is preferably curved outwardly, away from the shank 14 to facilitate insertion of the golf bag edge into the slot 26. When a golf bag B is inserted into the slot 26, it is firmly yet releasably retained therein due to the resilience of the finger 22. Referring to FIG. 3, the connecting arm 24 is preferably shaped so as to include first and second side grooves 32,34 which are suitable for retaining a golf club or green flag which is leaned thereagainst when the device 10 is removed from the golf bag B and inserted into the earth E as shown in FIG. 6B and described below.

Also projecting from the upper end 16 of the shank 14, preferably opposite the clip portion 20, is a golf club retention member or body 40. The club retention member 40 includes a planar, horizontal upper surface 42, a lower surface 44 which is parallel and spaced-apart from the upper surface, front and rear faces 46,48 which are parallel and spaced-apart, and parallel spaced-apart side faces 50,52. The club retention member 40 is generally block-shaped. Between the upper and lower surfaces 42,44, the club retention member 40 defines a thickness T which is substantial, preferably greater than 1" and most preferably at least 1.25".

With particular reference to FIG. 3, a plurality of grooves or slots 58, preferably two or three, are formed in the club retention member 40. The slots 58 extend between and open in the upper and lower surfaces 42,44 of the member 40 and also open through the front face 46. The slots preferably have a length between the upper and lower surfaces 42,44 of at least one inch. The slots 58 are defined in the member 40 with an inner, cylindrical portion 60 adapted for receipt of a shaft portion of an associated golf club to be retained and a beveled mouth portion 62 leading thereto from the front face 46. The mouth portion 62 converges from the front face 46 toward the inner portion 60 to guide a golf club shaft into the inner portion 60 through the gap 64. The inner portion 60 may also be formed with a slightly frusto-conical shape in a manner converging from the upper surface 42 toward the lower surface 44. The inner portion 60 is generally dimensioned to accommodate and frictionally retain a golf club shaft near the upper (grip) end as illustrated in FIG. 6A.

Figure 6B:
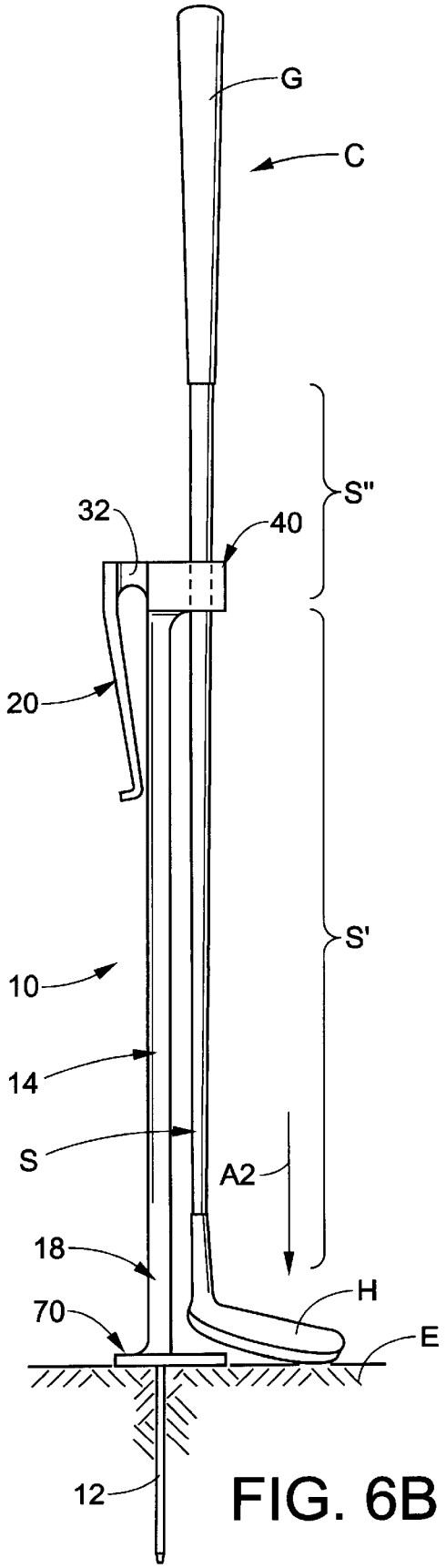
FIG. 6B is a side elevational view illustrating the golf club retention device of FIG. 1 as operatively inserted into a support surface so that the associated golf club is shifted to a second, released position which facilitates its separation from the club retention device.
Figure 6A:
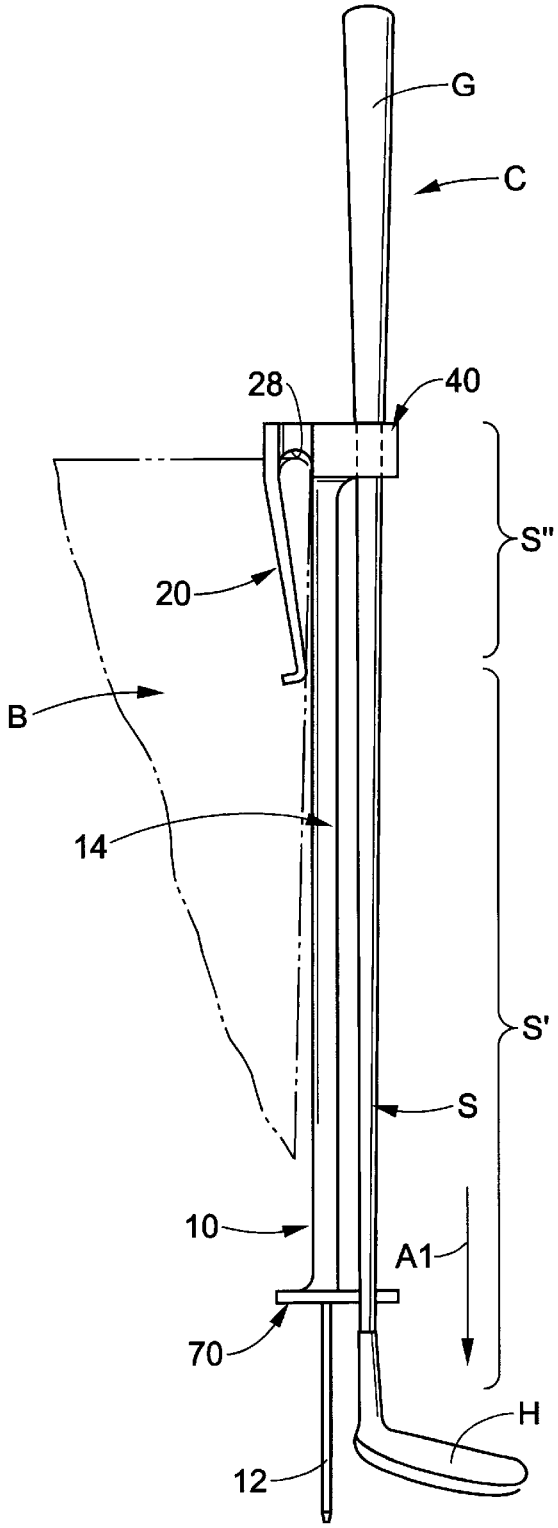
FIG. 6A is a side elevational view illustrating the golf club retention device of FIG. 1 as used to operatively secure an associated golf club in a first, locked position and connected to an associated golf bag.

With reference to FIGS. 6A and 6B, a golf club C comprises a shaft S, a head H, and a grip G. As is well known, the shaft S is frusto-conical and converges toward the head H so that the shaft S is larger in diameter near the grip relative to its diameter near the head H. The slots 58 are sized so that a lower, smaller-diameter portion S' of the shaft S is readily received in one of the slots 58 and removable therefrom by insertion or withdrawal through the beveled portion 62 and gap 64. Once the portion S' is inserted into a slot 58 and received in the inner portion 60, the shaft is moved downward (as indicated by the arrow A1) into a locked position so that the upper portion S" moves downwardly into engagement with the inner portion 60 of the slot 58. Because the upper shaft upper portion S" is larger in diameter than the lower shaft portion S' and unable to pass through the gap 64, the shaft portion S" is tightly, frictionally engaged in the slot inner portion 60 when the club C is in this locked position. Due to the thickness T of the club retention member 40, the shaft S is tightly gripped along a portion of its length so that the club C is inhibited from pivoting or swinging relative to the club retention device 10. If the inner portion 60 of the slot 58 is frusto-conical as described above, contact between the club shaft S and the retention member 40 is maximized so that the club is even more effectively inhibited from swinging when in the locked position (FIG. 6A).

Figure 4:
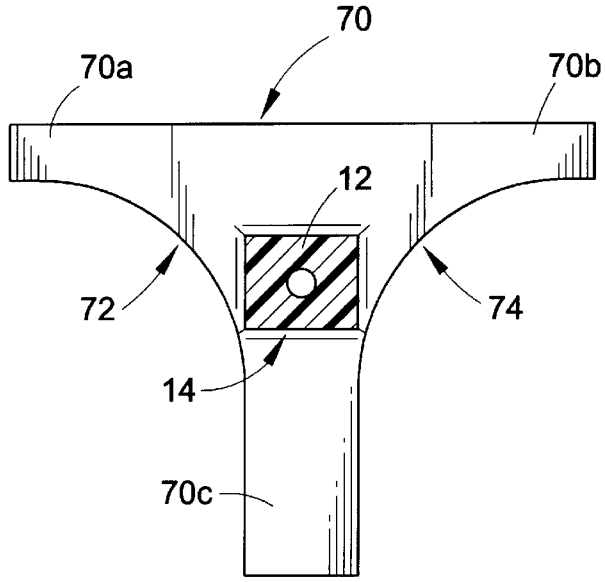
FIG. 4 is a cross-sectional view of the golf club retention device taken along line 4—4 of FIG. 2.

The club retention device 10 comprises a support flange 70 projecting outwardly from its lower end 18. The flange 70 supports the device 10 in a substantially vertical or upright orientation when the spike 12 is inserted into the earth E as shown in FIG. 6B. Prior to insertion of the spike 12 into the earth E, and when a club C is in the locked position, the club head H extends downwardly away from the retention member 40 beyond the flange 70. Referring to FIG. 4, the flange 70 includes projecting arms or fingers 70*a*, 70*b*, 70*c*, and includes curved or arcuate regions 72,74 connecting the arms 70*a*, 70*c* and 70*b*, 70*c*, respectively. These curved regions 72,74 lie closely adjacent the shank 14 of the device 10 and allow a club C to extend past the flange 70.

In use, the device 10, including one or more clubs C retained in a locked position, is removed from an associated golf bag B by disengagement of the clip portion 20 from the bag (of course, if a player's ball lands on the green, the device 10 is left attached to the golf bag B and only a putter is separated from the device for use in completing the hole). As illustrated in FIG. 6B, the spike 12 is inserted into the earth E in a location desired by a golfer so that the flange 70 contacts the earth and holds the device 10 in an upright position. Simultaneously, upon insertion of the spike 12 into the earth E, the head H of an associated club C contacts the earth E and is forced upwardly (as indicated by the arrow A2) to a point approximately level with the flange 70. This, then, causes the shaft S to move upwardly relative to the retention member 40 so that the shaft lower portion S' moves toward the member 40. Thus, the club shaft S is at least partially released from the locked position and moved into a released position where it is only loosely held in the inner portion 60 of a slot 58. A golfer is then able to easily and conveniently remove the club C from the device merely by slight additional upward movement of the shaft S so that the lower portion S' of the shaft enters the slot 58. In this position, the club is freely removable from the slot 58 through the gap 64 and mouth 62.

Figure 7:
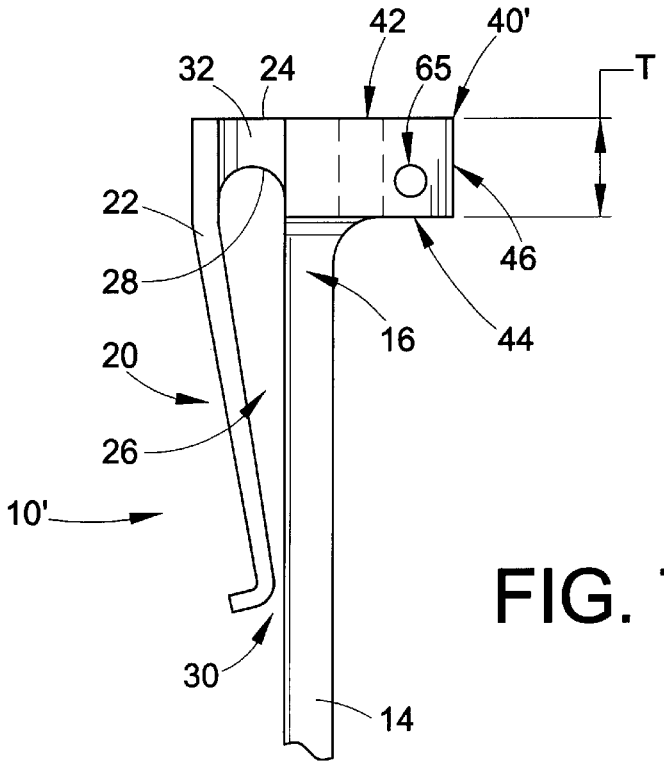
FIG. 7 is a partial side view of the golf club retention device.
Figure 8:
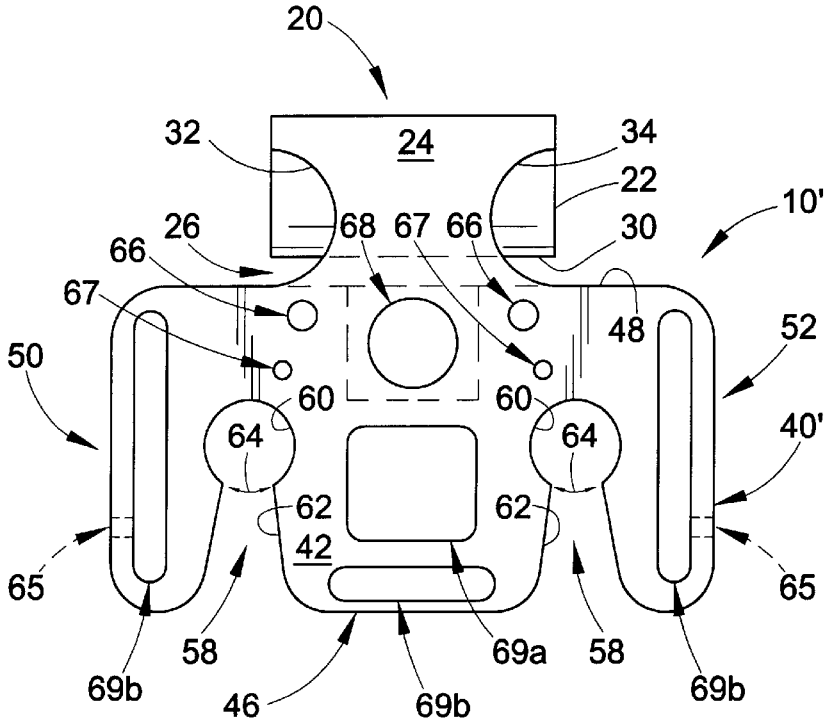
FIG. 8 is a top plan view of the golf club retention member illustrating the slots and bores formed therein.

With reference to FIGS. 7 and 8, another embodiment of the present golf club retention device 10' includes a modified club retention member 40' having various slots and bores formed therein. According to this embodiment, the device 10' includes a clip opening 65 defined in the golf club retention member 40' for the clipping of a personal towel, and tee openings 66 for selectively receiving and frictionally retaining golf tees. The device further includes, marker openings 67 defined in the golf club retention member 40' which receive's and frictionally retain ball markers. A pencil opening 68, defined in the golf club retention member 40', for receiving and retaining a pencil, elongated slots **69*b*, defined in the golf club retention member 40', for associated attachments and process cooling opening 69*a*** for cooling during manufacture.

The invention has been described with reference to preferred embodiments. Of course, modifications and alterations will occur to others upon a reading and understanding of the preceding specification. It is intended that the invention be construed as including all such modifications and alterations.

Having thus described the preferred embodiments, the invention claimed is:

1. A golf club caddy apparatus comprising:

an elongated shank having opposite first and second axial ends said second end defining a flange;

a spike projecting axially from said second axial end of the shank;

a clip portion for releasably securing said golf club caddy apparatus to a golf bag; and, a golf club retention member adjacent said first axial end of said shank, said golf club retention member defining at least two slots each adapted for frictionally engaging and fixedly retaining a shaft of an associated golf club with the shaft of the associated golf club extending substantially parallel to said elongated shank and a head of said golf club extends beyond said flange whereby when said spike is inserted into a support surface, the head of the associated golf club abuts the support surface and is moved axially toward said shank first end.

2. The golf club caddy apparatus as set forth in claim 1, whereby said shank is comprised of a composite material and formed into a web-like, one piece structure.

3. The golf club caddy apparatus as set forth in claim 1, wherein said clip portion comprises:

a finger connected to said shank by a horizontally extended connecting arm, said finger forming slot opening with said shank and defining a curved portion shaped to conform to an upper edge of a golf bag and an outwardly curved distal end to facilitate insertion of said upper edge of golf bag into said slot.

4. The golf club caddy apparatus as set forth in claim 3, wherein said connecting arm of said clip portion further includes first and second outwardly opening recesses, defined therein and adapted for receiving and retaining a golf club or a green flag by leaning thereagainst.

5. The golf club caddy apparatus as set forth in claim 1, wherein the golf club retention member defines a plurality of openings, each of said openings adapted for receiving and frictionally retaining a golfing accessory.

6. The golf club caddy apparatus as set forth in claim 1, wherein said at least two slots are each at least partially defined by a surface that converges in a direction moving toward said shank second end so as to tightly and frictionally engage a shaft of a golf club, inserted in said slot when said golf club is moved axially toward said shank second end.

7. The golf club caddy apparatus as set forth in claim 1, wherein each of said at least two slots is defined in said retention member to have a length which is at least one inch in dimension.

8. A golf club caddy apparatus for releasably retaining a plurality of golf clubs, said caddy apparatus comprising:

an elongated shank having opposite first and second axial ends;

a spike projecting from said second end of said shank and adapted for insertion into a golf course;

a flange projecting transversely from said second end of said shank and adapted for abutting said golf course when said spike is fully inserted into said golf course so that said caddy apparatus is self-supporting when said spike is fully inserted into said golf course;

a clip member located adjacent said first end of said shank and adapted for releasably securing said caddy apparatus to an associated golf bag; and, a golf club retention member located adjacent said first end of said shank and including at least two open slots defined therein, said slots conformed to receive and loosely hold a first axial shaft portion of an associated golf club and to receive and tightly hold a second axial shaft portion of an associated golf club, whereby, when a second axial shaft portion of an associated golf club is located in one of said slots and said spike is fully inserted into said golf course, the associated golf club contacts said golf course and the associated golf club moves axially relative to said slot so that said second axial shaft portion of the associated golf club is disengaged from said slot and said first axial shaft portion of the associated golf club is moved into said slot.

9. The golf club caddy apparatus as set forth in claim 8, wherein said flange includes recessed regions that permit an associated golf club held in one of said first and second slots to extend from and away from said second end of said shank past said flange.

10. The golf club caddy apparatus as set forth in claim 8, wherein said golf club retention member includes a plurality of openings defined therein, each of said openings adapted for receiving and retaining a respective golfing accessory.

11. The golf club caddy apparatus as set forth in claim 8, wherein each of the at least two slots is defined in said retention member to have a length of at least one inch in dimension.

12. The golf club caddy apparatus as set forth in claim 8, wherein the retention member defines a thickness of at least one inch between upper and lower surfaces thereof and wherein said at least two slots open into said upper and lower surfaces.

13. A golf club caddy apparatus for releasably retaining a plurality of golf clubs, said caddy apparatus comprising:

an elongated shank having opposite first and second axial ends;

a spike projecting from said second end of said shank and adapted for insertion into a golf course;

a flange projecting transversely from said second end of said shank and adapted for abutting said golf course when said spike is fully inserted into said golf course so that said caddy apparatus is self-supporting when said spike is fully inserted into said golf course;

a clip member located adjacent said first end of said shank and adapted for releasably securing said caddy apparatus to an associated golf bag; and, a golf club retention member located adjacent said first end of said shank and including at least two open slots defined therein, said slots conformed to receive and loosely hold a first axial shaft portion of an associated golf club and to receive and tightly hold a second axial shaft portion of the associated golf club, whereby, when the second axial shaft portion of the associated golf club is located in one of said slots and the spike is fully inserted into said golf course, the associated golf club contacts the golf course and is urged axially in said slot so that said second axial shaft portion is disengaged from the slot and the first axial shaft portion is moved into said slot, wherein said golf club retention member is defined by upper and lower faces, front and rear faces, and first and second side faces, wherein said at least two slots open into said upper and lower faces and in said front face.

14. The golf club caddy apparatus as set forth in claim 13, wherein each of said at least two slots is conformed with an inner portion adapted for receipt of the first and second axial shaft portions of an associated golf club, and an outer mouth portion that converges in a direction moving from said front face of said golf club retention member toward said inner portion of said slot.

15. The golf club caddy apparatus as set forth in claim 14, wherein said inner portion of each of said at least two slots is tapered and converges moving in a direction from said first end of said shank toward said second end of said shank.

* * * * *